US010213901B2

(12) United States Patent
Ras et al.

(10) Patent No.: US 10,213,901 B2
(45) Date of Patent: Feb. 26, 2019

(54) POLYCRYSTALLINE DIAMOND ABRASIVE ELEMENT AND METHOD OF ITS PRODUCTION

(75) Inventors: Anine Hester Ras, Johannesburg (ZA); Geoffrey John Davies, Randburg (ZA)

(73) Assignee: Element Six Abrasives SA, Luxembourg (LU)

( * ) Notice: Subject to any disclaimer, the term of this patent is extended or adjusted under 35 U.S.C. 154(b) by 1578 days.

(21) Appl. No.: 12/063,161

(22) PCT Filed: Aug. 11, 2006

(86) PCT No.: PCT/IB2006/002191

§ 371 (c)(1),
(2), (4) Date: Mar. 30, 2010

(87) PCT Pub. No.: WO2007/017745

PCT Pub. Date: Feb. 15, 2007

(65) Prior Publication Data

US 2010/0186303 A1 Jul. 29, 2010

(30) Foreign Application Priority Data

Aug. 11, 2005 (ZA) ..... 2005/06395

(51) Int. Cl.
*B24D 3/06* (2006.01)
*B24D 3/10* (2006.01)

(52) U.S. Cl.
CPC *B24D 3/10* (2013.01); *B24D 3/06* (2013.01)

(58) Field of Classification Search
None
See application file for complete search history.

(56) References Cited

U.S. PATENT DOCUMENTS

| | | | | |
|---|---|---|---|---|
| 3,372,010 | A * | 3/1968 | Parsons | 51/309 |
| 3,852,078 | A * | 12/1974 | Wakatsuki et al. | 51/309 |
| 4,108,614 | A * | 8/1978 | Mitchell | 51/309 |
| 4,273,561 | A * | 6/1981 | Fernandez-Moran Villalobos | 51/309 |
| 4,643,741 | A * | 2/1987 | Yu et al. | 51/295 |
| 4,902,652 | A | 2/1990 | Kume et al. | |
| 4,907,377 | A | 3/1990 | Csillag et al. | |
| 4,961,780 | A | 10/1990 | Pennington, Jr. | |
| 5,011,514 | A * | 4/1991 | Cho et al. | 51/309 |
| 5,096,465 | A * | 3/1992 | Chen et al. | 51/309 |
| 5,181,938 | A | 1/1993 | Krismer et al. | |
| 5,468,286 | A | 11/1995 | Wai-Chiu et al. | |

(Continued)

FOREIGN PATENT DOCUMENTS

| | | |
|---|---|---|
| CN | 1265699 A | 9/2000 |
| EP | 0 158 825 A | 10/1985 |

(Continued)

*Primary Examiner* — Colleen P Dunn
*Assistant Examiner* — Ross J Christie
(74) *Attorney, Agent, or Firm* — Haug Partners LLP

(57) ABSTRACT

Polycrystalline diamond abrasive elements made by incorporating low levels of at least one metal boride, the metal being selected from magnesium, calcium, aluminum, strontium, yttrium, zirconium, hafnium and chromium, and the rare earth metals, particularly cerium and lanthanum. The benefits of adding boron to polycrystalline diamond abrasive compacts are exploited together with simultaneously minimizing or eliminating the detrimental effects of the presence of oxygen.

11 Claims, 2 Drawing Sheets

(56) References Cited

U.S. PATENT DOCUMENTS

| | | | | |
|---|---|---|---|---|
| 6,098,731 | A | 8/2000 | Chow et al. | |
| 6,270,548 | B1 * | 8/2001 | Campbell et al. | 423/446 |
| 6,576,211 | B1 * | 6/2003 | Davies et al. | 423/446 |
| 6,676,750 | B1 * | 1/2004 | Davies et al. | 423/446 |

FOREIGN PATENT DOCUMENTS

| | | | |
|---|---|---|---|
| EP | 0 389 800 | A | 10/1990 |
| EP | 0 596 742 | A | 5/1994 |
| EP | 0 626 237 | A | 11/1994 |
| EP | 0 701 861 | A | 3/1996 |
| EP | 1 350 593 | A | 10/2003 |
| GB | 1376467 | | 12/1974 |
| GB | 1456765 | | 11/1976 |
| GB | 1496106 | | 12/1977 |
| GB | 2 362 388 | A | 11/2001 |
| GB | 2 362 655 | A | 11/2001 |
| JP | 64-17836 | A | 1/1989 |
| JP | 64-21032 | A | 1/1989 |
| JP | 1-103266 | A | 4/1989 |
| JP | 1-188272 | A | 7/1989 |
| JP | 3-28166 | A | 2/1991 |
| JP | 6-190731 | A | 7/1994 |
| JP | 8-133838 | A | 5/1996 |
| JP | 9-117808 | A | 5/1997 |
| JP | 9-142932 | A | 6/1997 |
| JP | 9-157026 | A | 6/1997 |
| WO | WO 99/06500 | A | 2/1999 |

* cited by examiner

POLYCRYSTALLINE DIAMOND ABRASIVE ELEMENT AND METHOD OF ITS PRODUCTION

This application is a 371 of PCT/IB2006/002191 filed on Aug. 11, 2006, published on Feb. 15, 2007 under publication number WO 2007/017745 A and claims priority benefits of South African Patent Application No. 2005/06395 filed Aug. 11, 2005, the disclosure of which is hereby incorporated by reference.

BACKGROUND TO THE INVENTION

The invention relates to polycrystalline diamond abrasive elements, a method of producing the polycrystalline diamond abrasive elements and polycrystalline diamond abrasive compacts incorporating them.

Polycrystalline diamond abrasive compacts (PDC) are used extensively in cutting, milling, grinding, drilling and other abrasive operations. A commonly used PDC is one that comprises a layer of polycrystalline diamond (PCD) bonded to a cemented carbide substrate. The layer of PCD presents a working face and a cutting edge around a portion of the periphery of the working surface.

Polycrystalline diamond typically comprises a mass of diamond particles containing a substantial amount of direct diamond-to-diamond bonding, and will generally have a second phase which contains a diamond catalyst/solvent such as cobalt, nickel, iron or an alloy containing one or more such metals, preferably nickel and more preferably cobalt.

A PDC is generally made under elevated temperature and pressure conditions (HPHT) at which the diamond particles are crystallographically stable.

The addition of boron in various forms to ultra hard abrasive compacts, such as PDCs, and cemented carbides is well known. Benefits such as the lowering of melting points which enables sintering to occur at lower pressures and temperatures (<=1200° C., JP 1 021 032) with less graphitization of the diamond (U.S. Pat. No. 4,902,652; JP 1 017 836), improved hardness of the solvent matrix (GB 1 456 765; U.S. Pat. No. 5,181,938), increased fracture toughness and corrosion resistance (U.S. Pat. No. 4,961,780; U.S. Pat. No. 6,098,731), low electrical resistivity (GB 1 376 467) and improved reproducibility of the compacts (GB 1 496 106; U.S. Pat. No. 4,907,377) are described.

However, none of the above patent references considers the role of oxygen in the sintering process. It is well known in the art that the presence of oxygen hinders the sintering process, thereby resulting in lower wear resistance of the final compact. Oxygen is typically introduced into the pre-sintered compact in the form of surface oxides on the diamond particles, or surface oxides or dissolved oxygen in metal particles mixed in with the diamond powder. For this reason, it is standard practice in the manufacture of sintered polycrystalline diamond abrasive compacts to outgas the diamond powder mixtures under vacuum prior to the HPHT sintering step, in an attempt to remove any surface oxides on the diamond particles or on any metal particles added to the diamond powder. This method is only partially successful, as trace amounts of oxygen still remain, so that inevitably there is some oxygen present during sintering, which is detrimental to the sintering process.

The prior art referred to earlier ignores this important aspect of obtaining efficient sintering. Even in U.S. Pat. No. 4,961,780, where the addition of boron oxide is claimed to increase the fracture toughness and the corrosion resistance, no mention is made of the deleterious effect of the oxygen introduced into the system via the boron oxide additive.

In JP 9142932, the deterioration of strength and wear resistance of the sintered diamond compact due to high contents of boron oxide or boric acid is mentioned, but no method of overcoming this problem is mentioned, other than to limit the amount of boron-oxygen additive to less than 30 volume percent.

SUMMARY OF THE INVENTION

According to one aspect of the invention there is provided a polycrystalline diamond abrasive element comprising from about 0.01 to about 4% by weight of the diamond material of at least one metal or metal compound, the metal being selected from the group consisting of magnesium, calcium, aluminium, strontium, yttrium, zirconium, hafnium, chromium and the rare earth metals, in particular cerium and lanthanum.

Preferably, the metal is selected from the rare earth metals, in particular cerium and/or lanthanum.

The metal or metal compound is preferably present in an amount by weight of the diamond material of less than about 2%, more preferably less than about 1.0%, and most preferably less than about 0.7%, and is preferably present in an amount of greater than about 0.01%, more preferably greater than about 0.1%, and most preferably greater than about 0.2%. It will be present in sufficient quantities to react with the trace oxygen present to form stable metal oxides, although this will not necessarily comprise the bulk of the speciation of the metal.

The polycrystalline diamond abrasive element preferably includes boron, which is a sintering aid used in the production thereof.

The metal or metal compound may be distributed throughout the polycrystalline diamond material, or it may be located in a discrete region or regions thereof, for example in a layer adjacent the working surface of the abrasive element.

According to a further aspect of the invention, a method of producing a polycrystalline diamond abrasive element includes the steps of providing a mass of diamond particles, preferably together with a source of catalysing material, and a source of at least one metal boride, wherein the metal component of the at least one metal boride is a strong oxygen getter (scavenger), to form an unbonded assembly, and subjecting the unbonded assembly to conditions of elevated temperature and pressure suitable for producing the polycrystalline diamond abrasive element.

The oxide of the metal component of the metal boride preferably has a high melting point, typically >2000° C., and the metal is preferably selected from the group consisting of magnesium, calcium, aluminium, strontium, yttrium, zirconium, hafnium, chromium and the rare earth metals, in particular cerium and lanthanum. In particular, the rare earth metal borides are of benefit in the present invention.

The unbonded assembly preferably includes a substrate, which produces a polycrystalline diamond abrasive compact on sintering of the unbonded assembly.

The substrate will generally be a cemented carbide substrate, which will also generally be the source of catalysing material. Some additional catalysing material may be mixed in with the diamond particles, typically in the form of a second phase comprising diamond catalyst/solvent.

The conditions of elevated temperature and pressure necessary to produce the polycrystalline diamond layer from a mass of diamond particles are well known in the art.

Typically, these conditions are pressures in the range 4 to 8 GPa and temperatures in the range 1100 to 1700° C.

BRIEF DESCRIPTION OF THE DRAWINGS

The invention will now be described in more detail, by way of example only, with reference to the accompanying figures in which.

DETAILED DESCRIPTION OF PREFERRED EMBODIMENTS

Figure 1:
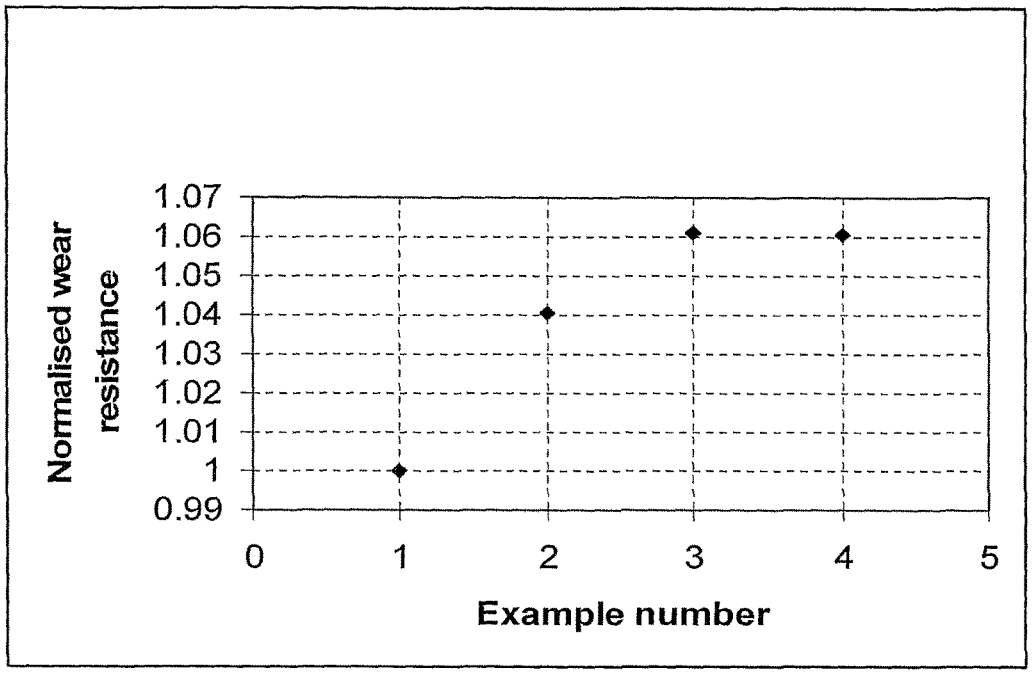
FIG. 1 is a graph of normalised wear resistance comparing the wear resistances of a number of preferred embodiments of polycrystalline diamond abrasive elements of the invention against a reference polycrystalline diamond abrasive element.

The present invention concerns polycrystalline diamond abrasive elements, compacts incorporating them and the production thereof. It also exploits the benefits of adding boron to polycrystalline diamond abrasive compacts while simultaneously minimising or eliminating the detrimental effects of the presence of oxygen. It has been found that by adding metal borides to the diamond powder, where the metal component of the boride is a strong oxygen getter, improved performance of the abrasive element is observed. The oxides of the metal components of such metal borides typically have a high melting point (>2000° C.). Examples are magnesium, calcium, aluminium, strontium, yttrium, zirconium, hafnium and chromium, and the rare earth metals, particularly cerium and lanthanum.

During the sintering process, metal borides added to the diamond powder dissociate by dissolution in the molten catalyst/solvent at the high temperatures required for sintering, which are typically >1200° C., and generally in the range 1100 to 1700° C. Upon dissociation the boron component alloys with the metal powder (typically cobalt) added to the diamond or with the molten cobalt metal infiltrating the diamond layer from the cemented tungsten carbide substrate, and/or locates itself at the grain boundaries, becomes incorporated in the newly recrystallised diamond and/or diffuses some way into the diamond particles, to provide the many benefits described in the prior art. At the same time, the liberated metal component of the metal boride such as cerium, for example, is believed to bind preferentially with any oxygen present in the system, forming discrete particles of inert metal oxide, thereby effectively removing the oxygen from the grain boundary interfaces where it would interfere with the sintering process. In this manner, a sintered diamond abrasive compact with unusually high wear resistance is obtained.

Typical levels of metal borides added to diamond powder are less than about 4% by weight of diamond powder, preferably less than about 2%, more preferably less than about 1.0%, and most preferably less than about 0.7%, and greater than about 0.01%, more preferably greater than about 0.1%, and most preferably greater than about 0.2%. The most preferable level will be different and specific for each metal boride type. Particle sizes of the metal borides range from nanosized particles (of the order of 10 nanometers) through to micron sized particles, typically 10 μm, and preferably 0.1 μm to 2 μm. The metal boride may be added as a powder to the diamond powder, and mixed prior to sintering, or it may be granulated on its own or with the diamond powder. It is also envisaged that the metal boride could be coated on the discrete diamond particles, for example using a sol-gel technique, or could possibly even be infiltrated from a substrate containing it as an additive. The metal boride source may consist of a mixture of different metal borides, but in total will add up to not more than 4% by weight of the diamond powder.

The metal boride can be distributed throughout the thickness of the polycrystalline diamond material, which is typically in the form of a layer. Alternatively, it may be located in discrete regions of the polycrystalline diamond material, for example in a layer adjacent the working surface of the abrasive element. In such a case, it could be present in the pre-composite as a powder or compact layer overlying the diamond layer, or as an inner coating in the cup of the pre-composite, or as a separately admixed diamond/metal boride layer.

The diamond particles range in size from 5 nanometer to 100 μm, and preferably from 0.75 μm to 45 μm. The diamond powder may consist of a mixture of different size fractions from within these ranges, to give a multimodal size distribution (as taught in EP 0 626 237 and U.S. Pat. No. 5,468,286), or may be only one of these sizes, to give a monomodal size distribution.

The solvent/catalyst phase may be introduced either as a metal powder added to the diamond powder/metal boride mix, and/or may be introduced by infiltration from the substrate/backing during HPHT treatment. It is also possible to provide a metal film (shim) of the desired infiltrant (typically Co, Ni, Fe, Cr or alloys) between the diamond layer and the substrate, to allow for infiltration of the molten metal film into the diamond layer during sintering. The substrate/backing may be a cemented tungsten carbide (e.g. Co/WC), a cermet (e.g. W/TiC, W/Ti/Ta or similar material), or any material to which polycrystalline diamond may show good adhesion. The solvent/catalyst will typically be present in the compact in less than 30% by volume of the diamond layer, and preferably in 20% or less.

The diamond layer may be supported on a substrate, which may be non-planar in nature, or may be unbacked, for use as a standalone wear resistant material. An example of this is in applications where thermal stability is important, such as gauge cutters in rock drilling applications, or wear parts that are exposed to high temperatures.

The manufacture of diamond tools such as saw segments, where the diamond particles are embedded in a metal bond, and no intergrowth between the diamond particles occurs during sintering, would also benefit from the process of this invention.

In addition to right cylindrical cutting or abrading elements, the polycrystalline diamond abrasive elements of the invention can also be in the form of domed cutters, such as bullets, buttons or studs, for example.

The metal infiltrant or additive which effects sintering may be iron, cobalt, nickel, or mixtures thereof or alloys typically used in saw segment manufacture using metal bonds.

The invention will now be described in more detail, by way of example only, with reference to the following non-limiting examples.

Example 1 (Comparative Example)

A number of polycrystalline diamond compacts were made in the following way: 3 g of diamond powder with average particle size of 22 μm was placed in contact with a tungsten carbide substrate and treated at high pressure and temperature (approximately 1300° C. and 5 GPa). After sintering, the PDC cutters were ground to size and subjected to wear tests by pressing the polycrystalline diamond cutting edge against a granite bar turning at high speed. The wear resistance thus measured served as a baseline for comparison with the metal boride doped PDC cutters in Examples 2 to 4.

Example 2

Polycrystalline diamond compacts were manufactured according to Example 1, but an amount of particulate aluminium diboride of 0.5% by weight of the diamond powder was added prior to sintering at high pressure and temperature. The wear resistance of these cutters was compared with those obtained in Example 1, and showed on average a 4% increase, indicating an improvement in wear resistance due to the presence of the aluminium diboride in the PDC cutter.

Example 3

Figure 2:
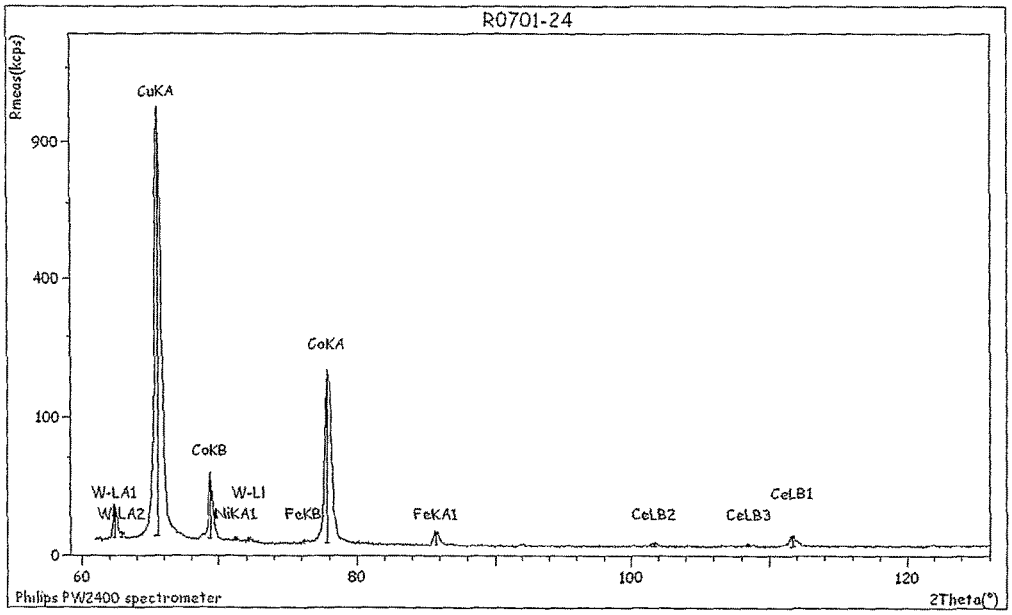
FIG. 2 is an XRF analysis of one of the preferred embodiments of the invention referred to in FIG. 1.

Polycrystalline diamond compacts were manufactured according to Example 1, but particulate cerium hexaboride of 0.7% by weight of the diamond powder was added prior to sintering at high pressure and temperature. The wear resistance showed a 6% improvement. The presence of cerium was detected by XRF analysis, as seen in FIG. 2.

Example 4

Figure 3:
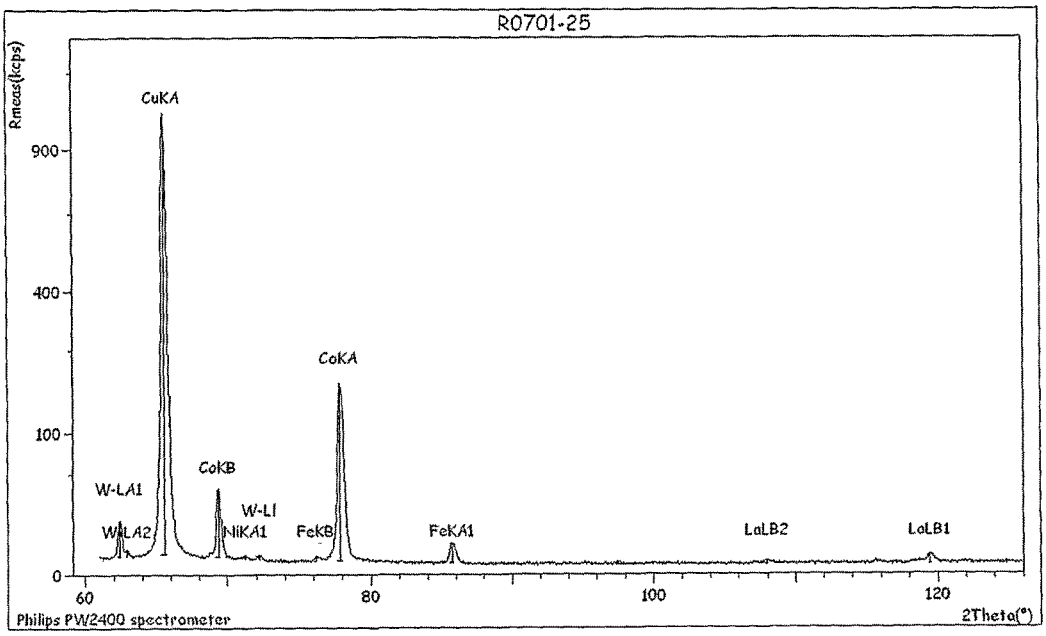
FIG. 3 is an XRF analysis of another one of the preferred embodiments of the invention referred to in FIG. 1.

Polycrystalline diamond compacts containing 0.7% by weight of particulate lanthanum hexaboride were manufactured according to the above methods, and the wear resistance showed a 6% improvement. The presence of lanthanum was detected by XRF analysis, as seen in FIG. 3.

The invention claimed is:

1. A polycrystalline diamond abrasive element comprising diamond material, a solvent/catalyst phase, a metal boride, and from about 0.01 to about 4% by weight of the diamond material of at least one metal or metal oxide, the metal or the metal of the metal oxide being a strong oxygen getter and selected from the group comprising magnesium, calcium, aluminum, strontium, yttrium, zirconium, hafnium, chromium and the rare earth metals.

2. An abrasive element according to claim 1, wherein the metal is selected from the rare earth metals.

3. An abrasive element according to claim 1, wherein the metal is cerium or lanthanum.

4. An abrasive element according to claim 1, wherein the metal is present in an amount by weight of the diamond material of between about 0.01% to less than about 2%.

5. An abrasive element according to claim 4, wherein the metal is present in an amount by weight of the diamond material of between about 0.01% to less than about 0.7%.

6. An abrasive element according to claim 1, wherein the metal is present in an amount by weight of the diamond material of greater than about 0.1% to about 4%.

7. An abrasive element according to claim 6, wherein the metal is present in an amount by weight of the diamond material of greater than about 0.2% to about 4%.

8. An abrasive element according to claim 1, wherein the at least one metal or metal oxide is distributed throughout the polycrystalline diamond material.

9. An abrasive element according to claim 1, wherein the at least one metal or metal oxide is located in a discrete region or regions thereof.

10. An abrasive element according to claim 9, wherein the at least one metal or metal oxide is located in a layer adjacent the working surface of the abrasive element.

11. A polycrystalline diamond abrasive element according to claim 1, wherein the solvent/catalyst phase is selected from cobalt, nickel, iron or an alloy thereof.

* * * * *